US005599241A

United States Patent [19]

Pritchett et al.

[11] Patent Number: 5,599,241

[45] Date of Patent: Feb. 4, 1997

[54] GOLF CLUB

[75] Inventors: Ronnie Pritchett, Palm Desert, Calif.; Brenda Morgan, 41-795 Largo, Palm Desert, Calif. 92211

[73] Assignee: Brenda Morgan, Palm Desert, Calif.

[21] Appl. No.: 342,239

[22] Filed: Nov. 18, 1994

[51] Int. Cl.[6] ..... A63B 69/36

[52] U.S. Cl. ..... 473/238; 473/314; 473/251

[58] Field of Search ..... 273/164.2, 164.1, 273/167 R, 169, 170, 168, 167 J, 80 A, 80 C; 473/251, 238, 314

[56] References Cited

U.S. PATENT DOCUMENTS

| | | | |
|---|---|---|---|
| 3,578,332 | 5/1971 | Caldwell | 273/164.2 |
| 4,749,196 | 6/1988 | Podgor | 273/164.2 |
| 5,131,656 | 7/1992 | Kinoshita | 273/164.1 |

FOREIGN PATENT DOCUMENTS

| | | | |
|---|---|---|---|
| 19725 | of 1903 | United Kingdom | 273/167 R |
| 14608 | of 1905 | United Kingdom | 273/80 C |
| 324620 | 1/1930 | United Kingdom | 273/164 |

*Primary Examiner*—Vincent Millin
*Assistant Examiner*—Charles W. Anderson
*Attorney, Agent, or Firm*—John Lezdey

[57] ABSTRACT

A golf club especially constructed to eliminate the backspin imparted on a golf ball when striking the ball and to improve the player's control and accuracy of the golf putt by ensuring that the center of the ball, the center of the clubface and the center of the golf club all meet at one point when the putter strikes the ball.

9 Claims, 2 Drawing Sheets

GOLF CLUB

FIELD OF THE INVENTION

The present invention relates to golf clubs, and more particularly, to golf putters having an advantageous construction.

BACKGROUND OF THE INVENTION

It is the principal object of the present invention to construct a golf club that will improve the performance of golfers. The prior art has taught a variety of clubface and shaft constructions and arrangements for golf putters. However, many putters do not comply with the rules of the United States Golf Association (USGA) because their designs run afoul of the required specifications or they require the player to assume an illegal stance when putting. Hence, such putters cannot be used in tournaments conducted pursuant to, sponsored or sanctioned by the USGA. See Rule 2 and Appendix II USGA Re-Drafts (Sep. 11, 1981), which are incorporated herein by reference.

The construction of a putter according to the rules require that the shaft or neck or socket of a putter be fixed at any point in the head and need not remain in line with the heel. The axis of the shaft from the top to a point not more than five (5) inches (127 mm) above the sole shall diverge in the toe-heel plane from the vertical by at least ten (10) degrees in relation to the horizontal line determining the length of the head.

The length of the clubhead shall be greater than the breadth. These measurements are made on horizontal lines between the vertical projections of the extremities when the clubhead is grounded in its normal address position.

Conventional putters have a flat face that causes the ball to skid on impact, especially on long putts. The skidding causes loss of control of the ball when the ball jumps off the ground. Moreover, skidding can amount to 20% of the distance to the hole.

A conventional putter is approximately 1 inch high which is smaller than 1.62 inches, the height of a golf ball. Consequently, the center of gravity of the conventional putter is lower than the center of gravity of the ball. Thus, when a conventional putter strikes the ball, the center of the putter makes contact below the center of the ball creating backspin in the ball.

When the club strikes the ball below the center line of the ball two things happen. First, the ball is made to travel in the direction of the swing of the club. This is the largest impact to the ball. Second, the stroke causes the ball to spin backwards. The torque or movement exerted on the ball is equal to the force of the club strike times the distance away from the center of the ball the ball is hit. This torque is small compared to the force that makes the ball go forward.

As the ball travels forward, it will slide along the grass for an almost imperceivable time. The force of friction between the grass and the ball will create a much larger torque than the torque mentioned above. The torque from the friction creates topspin which overtakes the backspin initially present in the ball.

Striking the center of ball is ideal because it eliminates the backspin problem. If you strike the ball below its center, the ball first spins backward, then turns to topspin during its forward roll due to friction with the grass. This slows the ball down and causes hops and skips. The problem of backspin is discussed in more detail in the drawings and description of preferred embodiments hereinafter.

Conversely, if you hit above the center of the golf ball it drives the ball down with topspin roll, but this also causes hops, skips and loss of speed.

Therefore, there exists a need to create a club that will guarantee that the ball will be struck at the center point. The backwards roll can be eliminated and a more efficient putt can be produced.

U.S. Pat. No. 5,295,685 discloses a golf club having a protruding mass on the top of the clubhead. However, there is also provided a mass concentration on the striking face which may result in off center hits.

The present invention seeks to solve these problems and improve the player's putting performance by providing a putter that is constructed so that the center of the clubface strikes the center of the ball. This construction is in compliance with the USGA rules and provides the player with an improved balance and feel of the club and more control over the putt which results in better putting performance.

By having the shaft connected through the center of the clubface, through the arch at some angle, one creates the maximum mass of weight behind the center of the club to strike the ball. Without question the best transfer of energy always occurs from the center of the clubface to the center of the golf ball. This maximizes the energy transferred. In contrast, energy is lost when a different part of the clubface strikes the ball.

If the center of the clubface strikes the center of the golf ball, normal backspin in the ball is eliminated. The ball will first scoot, then due to friction begin its topspin roll which is the desired roll. This type of hit achieves a perfect roll of topspin quicker and with less effort.

The present invention provides a greater probability that the center of the ball will meet the center of the clubface when executing a putt.

SUMMARY OF THE INVENTION

In accordance with the present invention, a golf club, especially a putter, is constructed so that the center of the clubface meets the center of the ball when the clubface strikes the ball. The shaft of the golf putter is aligned at an angle of about 50° to 90° in relation to the clubface. The clubface is provided with an arch about the center. The arch of the clubface is at least about 1.62 inches high, the height as a golf ball. Indicator means are situated on or about the clubface to allow the player to align up the ball and putter so that a solid strike of the ball will occur each stroke. At least one indicator means such as a mark can be located at the top of the clubface to allow for top viewing. This mark can be axially aligned with another means or mark located at the center of the clubface.

Accordingly, it is an object of the present invention to provide a new and improved golf club that assures the center of the clubface meets the center of the ball when the clubface strikes the ball.

It is a further object of the present invention to eliminate the backspin intrinsic to every golf putt.

It is a further object of this invention to provide a putter that improves the balance and feel of the club.

It is a further object of the invention to provide a putter that improves the player's control over a putt.

It is a still further object of the invention to provide a golf club that improves the player's score without violating the rules and ethics of the game.

Other objects and advantages will become more apparent from the following detailed description of the preferred embodiments and the accompanying drawings.

DESCRIPTION OF THE PREFERRED EMBODIMENTS

Figure 1:
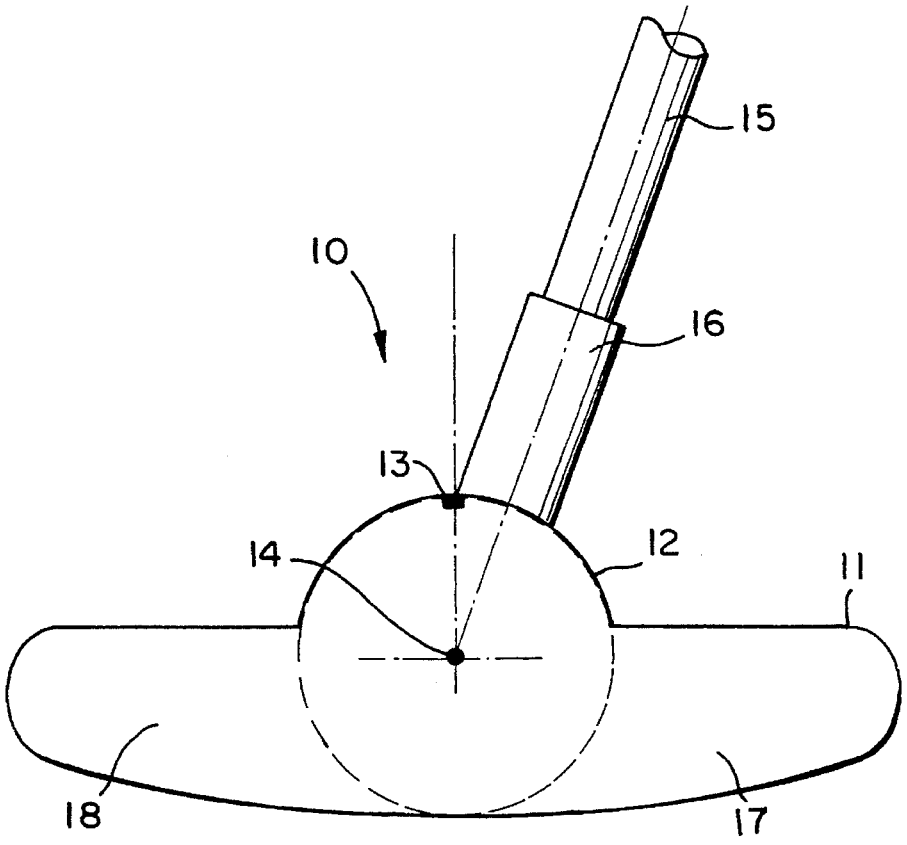
FIG. 1 is a front view illustrating a preferred embodiment of the invention.
Figure 4:
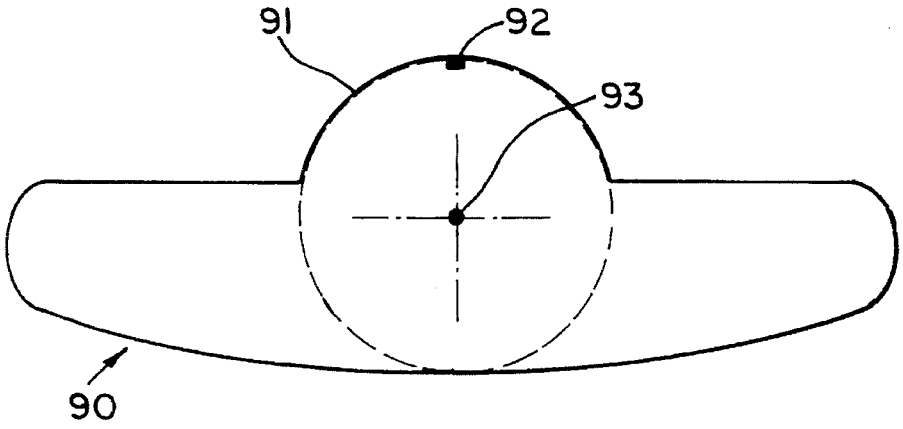
FIG. 4 is a front view illustrating the clubface of a preferred embodiment of the invention.
Figure 2A:
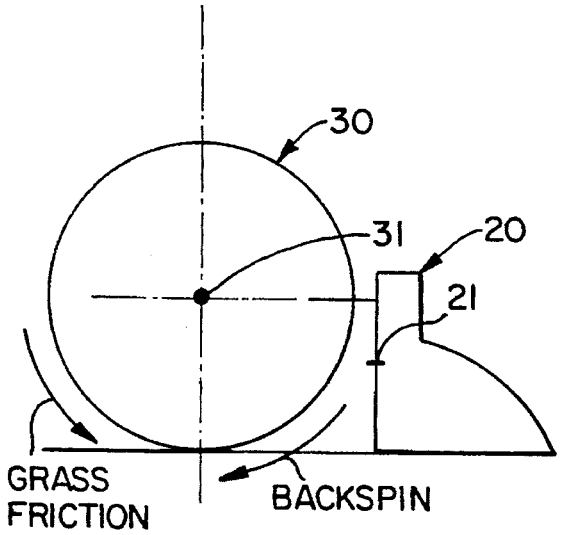
FIG. 2A is a side view of a conventional golf putter striking a golf ball.
Figure 2B:
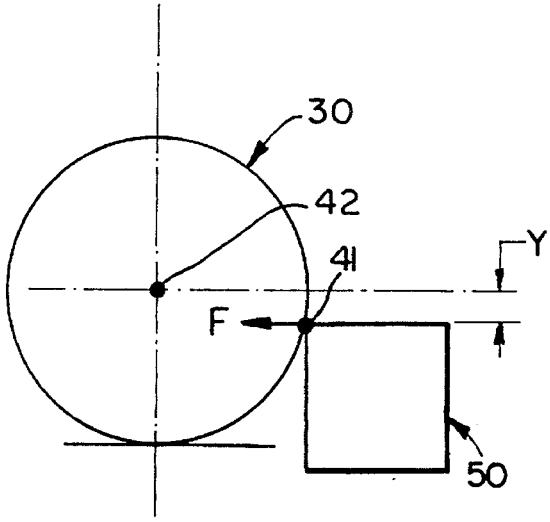
FIG. 2B is a free body diagram of FIG. 2A illustrating the forces present when a golf putter strikes a golf ball.
Figure 2C:
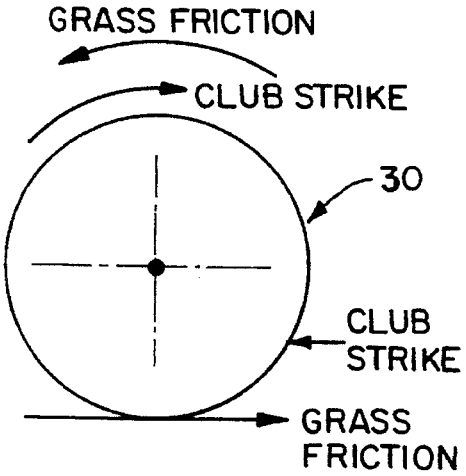
FIG. 2C is a free body diagram of a golf ball in motion after being struck by a golf putter and illustrates the forces affecting the travel of the ball.
Figure 3:
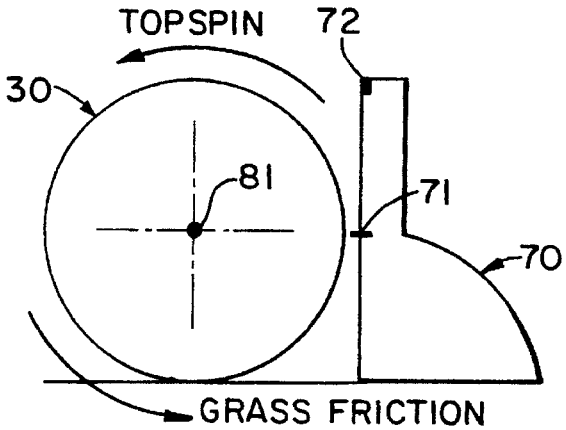
FIG. 3 is a side view of a preferred embodiment of the invention as it strikes a golf ball.

Referring more particularly to the drawings, FIGS. 1, 3 and 4 show various views of the invention, while FIGS. 2A, 2B and 2C show comparative views of a conventional golf putter striking a golf ball as well as the forces therein that affect the travel of the ball, and of which the present invention seeks to control to improve the accuracy of each golf putt.

As shown in FIG. 1, the clubface 11 of the invention 10 has two indicator marks 13 and 14; one mark 13 is at the top of the clubface 11 and the other mark 14 is at the center of the clubface 11. The middle portion 12 of the clubface 11 is optionally circular and identical in size and shape to a professional golf ball. The two ends 17 and 18 of the clubface 11 are called the toe 18 and heel 17 portions of the clubface 11. The heel portion 17 is the end closer to the player's feet. While the entire clubface measures about 1 inch high at each end and about 4¾ inches long from end to end, the circular middle portion of the face is exactly 1.62 inches high, the same height as a golf ball. Thus, the radii of the circular middle portion and the golf ball are each 0.81 inches long. It is understood that the height and length of the clubface may vary according to the type of club being utilized.

Advantageously, for use by many non-professional golfers the shaft 15 of the golf club makes a 70° angle with the horizontal axis when viewed from the front. The shaft 15 may be integral with the clubface 11 as one unit or it may be a separate unit inserted into a sleeve 16 situated on top of the circular portion or the heel and fastened thereto.

FIG. 2A shows a conventional putter 20 and a professional golf ball 30. The conventional putter clubface is about 1 inch high, which is smaller than the 1.62 inch height of a golf ball. Consequently, the center of the conventional putter 21 is lower than the center of the ball 31.

FIG. 2B shows the effect of striking a golf ball 30 with a conventional putter 50. The conventional putter 50 strikes the ball 30 at a point 41 below the ball's center point 42 causing backspin on the ball.

FIG. 2C show the forces acting on a moving golf ball 30 after it is struck with a conventional club. The friction between the grass and the ball reverses the spin on the ball eliminating the backspin and creating topspin.

FIG. 3 illustrates the present invention. The golf putter 70 is about 1.62 inches high. The golf ball 30 is about 1.62 inches high. Therefore, the center point of the golf putter 71 is the same height as the center of the golf ball 81. Advantageously, an indicator mark 72 is situated at the top of the club axially in line with the center point 71. This design increases the probability that when the putter strikes the ball, the center of the clubface of the putter will meet at the same point as the center of the ball. By having these two points meet during the stroke, the putter strikes the ball in the direction of the swing causing the ball to scoot along the ground. This will eliminate the unnecessary backspin created by conventional putters. Scooting the ball along the ground creates friction between itself and the ground causing the ball to produce topspin, which is the desired roll that golfers prefer.

Moreover, hitting the center of the ball with the center of the clubface maximizes the mass of the weight behind the center of the ball. This gives a true hit to the ball.

The present invention contemplates a plurality of markings on the clubface for alignment purposes. FIG. 4 shows two indicator marks 92 and 93 on the circular middle portion (arch) 91 of the clubface 90. One mark 93 is at the center of the arch 91. The marks can be any of a variety of designs. Preferably, the marks 92 and 93 are in line with each other, which provides excellent alignment when striking the ball. The line on top of the putter along with the marks allow the player to perfectly align the ball with the putter. Thus, the player will strike the ball solid every stroke and the center of the putter will strike the center of the ball.

Preferably, the perfectly balanced putter is created by having the center line of the shaft in line with the center of the clubface and having the height of the arch at least equal to the height of a ball (1.62 inches).

While the invention as illustrated depicts a golf putter, it is not limited to such, and in fact, it is contemplated that the invention is equally applicable to golf drivers and fairway clubs.

As various changes may be made in the form, arrangement and construction of parts of the preferred embodiments without departing from the spirit of the invention, it is understood that all matters herein are to be taken as illustrative and not in a limiting sense.

We claim:

1. In a golf club having a shaft and a flat clubface the improvement which comprises that the center of the shaft is in alignment with the center of the clubface and at an angle and passing through the shaft between 50° and 900° with respect to the vertical, the clubface having an integral middle portion with an arch of at least about 1.62 inches high said shaft being attached to said middle portion, and indicator means for aligning up the golf club with a golf ball.

2. The golf club of claim 1 wherein the indicator means consist of at least two marks, the first mark being situated at about the intersection of the clubface and the center of the clubface and axially aligned with a second mark situated atop on the clubface, wherein the first mark is also situated at about the center of the clubface and the center of the shaft.

3. The golf club of claim 1 wherein the shaft is aligned at approximately a 70° angle in relation to the horizontal axis of the clubface.

4. The golf club of claim 1 wherein the clubface is about 4¾ inches long and about 1 inch high.

5. The golf club of claim 1 wherein the golf club is unitary.

6. The golf club of claim 1 wherein the shaft is affixed to the clubface.

7. The golf club of claim 1 which is a putter.

8. The golf club of claim 1 wherein said clubface has a circular middle portion.

9. The golf club of claim 1 wherein the center line of the shaft is in line with the center of the clubface and the height of the arch is about the height of the ball.

* * * * *